United States Patent [19]

Nelson

[11] 4,235,442

[45] Nov. 25, 1980

[54] ELECTRONIC BOARD GAME SYSTEM

[75] Inventor: Ronald C. Nelson, Forest Park, Ill.

[73] Assignee: Fidelity Electronics, Ltd., Miami, Fla.

[21] Appl. No.: 828,147

[22] Filed: Aug. 26, 1977

[51] Int. Cl.[3] ..... A63F 3/02

[52] U.S. Cl. ..... 273/237

[58] Field of Search ..... 35/8 R; 273/1 E, 85 G, 273/237, 238, DIG. 28; 235/92 GA; 364/410, 200, 900; 340/323 R

[56] References Cited

U.S. PATENT DOCUMENTS

| | | | |
|---|---|---|---|
| 3,395,463 | 8/1968 | Worden et al. | 35/8 R |
| 3,654,392 | 4/1972 | Beinhocker et al. | 273/237 X |
| 3,683,363 | 8/1972 | Khlebutin | 273/238 X |
| 3,760,404 | 9/1973 | Khlebutin | 273/238 X |
| 3,888,491 | 6/1975 | Bernard et al. | 273/237 |
| 3,973,244 | 8/1976 | Lovercheck et al. | 364/200 |
| 4,019,745 | 4/1977 | Mustelier | 273/237 |
| 4,026,555 | 5/1977 | Kirschner et al. | 273/85 G |
| 4,073,067 | 2/1978 | Beach | 273/237 X |
| 4,156,928 | 5/1979 | Inose et al. | 273/237 |

FOREIGN PATENT DOCUMENTS 2265426 10/1975 France ..... 273/237

OTHER PUBLICATIONS

*Electronic Design;* "Chess and Chance Games Win at Electronics Show"; Feb. 15, 1977; p. 21.

*Electronics;* "Chessmate"; Mar. 4, 1976; p. 44.

*Popular Electronics;* "Altair 8800"; Roberts, H. E., and Yates, William; Jan. 1975; pp. 33–38.

*Popular Science;* "Games Computers Play"; Oct. 1970; p. 44.

*Primary Examiner*—Vance Y. Hum

*Attorney, Agent, or Firm*—Dressler, Goldsmith, Shore, Sutker & Milnamow, Ltd.

[57] ABSTRACT

An electronic board game system for a game normally played by two players, such as chess, in which the game system makes respective moves to moves by a player, displays the moves and in which the position and identity of each piece can be displayed, as well as other indicators.

11 Claims, 5 Drawing Figures

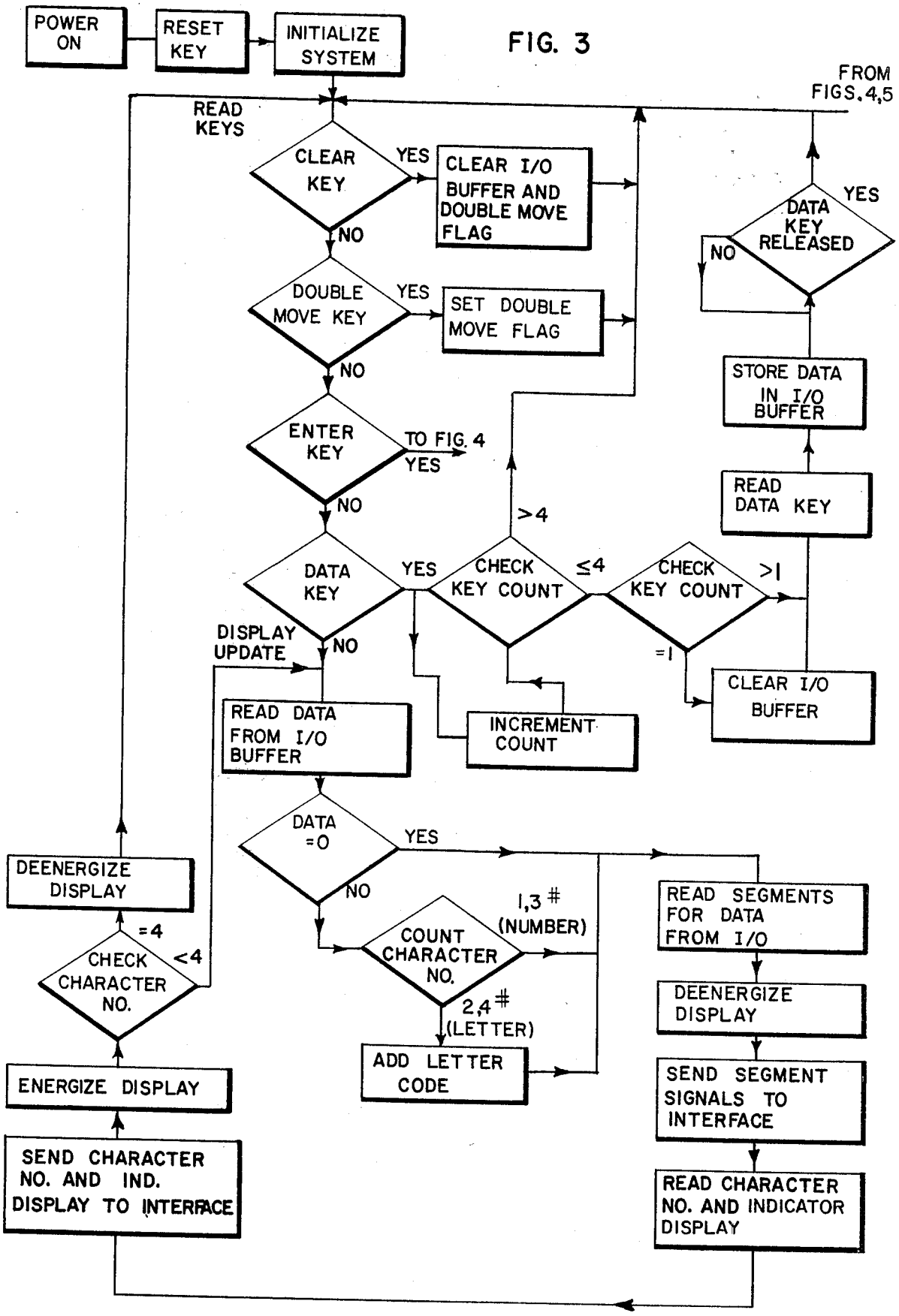
POWER ON
RESET KEY
INITIALIZE SYSTEM
FIG. 3
FROM FIGS. 4,5
READ KEYS
CLEAR KEY
YES
CLEAR I/O BUFFER AND DOUBLE MOVE FLAG
NO
DOUBLE MOVE KEY
YES
SET DOUBLE MOVE FLAG
NO
ENTER KEY
TO FIG. 4
YES
NO
DATA KEY
YES
CHECK KEY COUNT
>4
≤4
CHECK KEY COUNT
>1
=1
NO
DISPLAY UPDATE
READ DATA FROM I/O BUFFER
INCREMENT COUNT
CLEAR I/O BUFFER
READ DATA KEY
STORE DATA IN I/O BUFFER
DATA KEY RELEASED
YES
NO
DATA =0
YES
NO
COUNT CHARACTER NO.
1,3 # (NUMBER)
2,4 # (LETTER)
ADD LETTER CODE
READ SEGMENTS FOR DATA FROM I/O
DEENERGIZE DISPLAY
SEND SEGMENT SIGNALS TO INTERFACE
READ CHARACTER NO. AND INDICATOR DISPLAY
DEENERGIZE DISPLAY
CHECK CHARACTER NO.
=4
<4
ENERGIZE DISPLAY
SEND CHARACTER NO. AND IND. DISPLAY TO INTERFACE

ELECTRONIC BOARD GAME SYSTEM

BACKGROUND OF THE INVENTION

The present application relates to electronic board games and more particularly to games normally played between two competitors which permits solitary play with the game system substituting for the second competitor.

One area of attraction associated with data processing apparatus has always been the ability to have the computer play games against human competitors. Advances in data processing technology continue to make this area of computer use more available to those persons who do not have access to or are not trained to operate sophisticated equipment. The popularity of many video games is merely illustrative of the intense interest in this area.

One game which has always intrigued those involved with computers is the game of chess. The variations and permutations involved in the game of chess are sufficiently great and have limited the use of computers for chess playing to relatively large scale high-powered devices. However, the recent advances in the microprocessor capability have resulted in techniques in which it is mathematically possible to have an electronic opponent play an interesting game of chess for at least non-expert human opponents.

For example, programs for playing chess have been developed for implementation on programmable calculators such as the Hewlett-Packard 9810A. Such programs are available from that company and are described, for example, in an article by Alan A. Wray entitled "A Chess Playing Program For The 9810A" published by that company. Other interesting publications on computer chess playing include a book by David Levy entitled "Chess and Computers", Computer Science Press, 1976; a paper entitled "The Greenblatt Chess Program", by R. D. Greenblatt, D. E. Eastlake, III and S. D. Crocker in Proceedings, Fall Joint Computer Conference, 1967; and "Chess-Playing Programs and the Problem of Complexity", by A. Newall, J. C. Shaw and H. A. Singer, at pages 39–70 of Computers and Thought, McGraw Hill, 1963.

These and probably other articles describe some of the basic techniques utilized by computers in evaluating chess moves in order to play a basis competent game against a non-expert human opponent.

However, in order to implement such a chess game, it is not just sufficient to have a technique for the computer to evaluate the possible chess moves it might make. It is also necessary to produce a device capable of being operated by a person who understands the game, but not necessarily computers, and which provides the necessary input and output responses to permit the game to be played, as well as features and capabilities to make the device attractive and practical. Such features should be incorporated and available while retaining simplicity of operation and maintaining reasonable cost limitations.

SUMMARY OF THE INVENTION

In accordance with the present invention there is provided a practical, computerized chess game in which the game system is the opponent for a human player. The electronic board game system in accordance with the present invention provides means for the player to enter moves by identifying the specific position from which a move is to be made and to which a move is to be made, and for entering that move into the system. The system responds by checking the validity of the move, by making the move in memory, and by then making all possible responses to that move and evaluating those responses in accordance with suitable stored evaluation criteria, e.g., the type described in the articles and embodied in the Hewlett-Packard program referred to above. As a result of this evaluation, one of the moves is selected as the most suitable response and the system is capable of effecting that move in the board memory and of displaying that move to the player who makes the corresponding move manually on the game board.

The system in accordance with the present invention provides a capability of displaying additional information such as each position on the board which contains a piece, the identity of the piece at that location, whether the player's piece is in check, and whether the game system has lost. Thus, in accordance with one aspect of the present invention the system sequentially displays in response to a manually entered request the coordinates of each position containing a piece and the identity of that piece and continues to sequentially display such information until such time as a move is made by the player.

As part of the move evaluation, the system provides an absolute evaluation output which indicates that the game has lost, i.e., the game's king is in check and cannot get out of check, and provides an output indicative of this result for displaying to the player the fact that the computer has lost. An additional output is also provided to display to the player the fact that the player's king is in check after the computer game has made its move.

Thus, there is provided in accordance with the present invention an electronic game which provides an interface between game evaluation criteria and a player, which accepts various inputs from a player and provides various outputs to the player resulting in a system that embodies a playable interface between the computer game itself and the player who may understand the game but not the sophisticated electronics required.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

BRIEF DESCRIPTION OF THE DRAWINGS

FIGS. 3–5 are operational flow diagrams of the system incorporating the present invention.

DESCRIPTION OF PREFERRED EMBODIMENT

Figure 1:
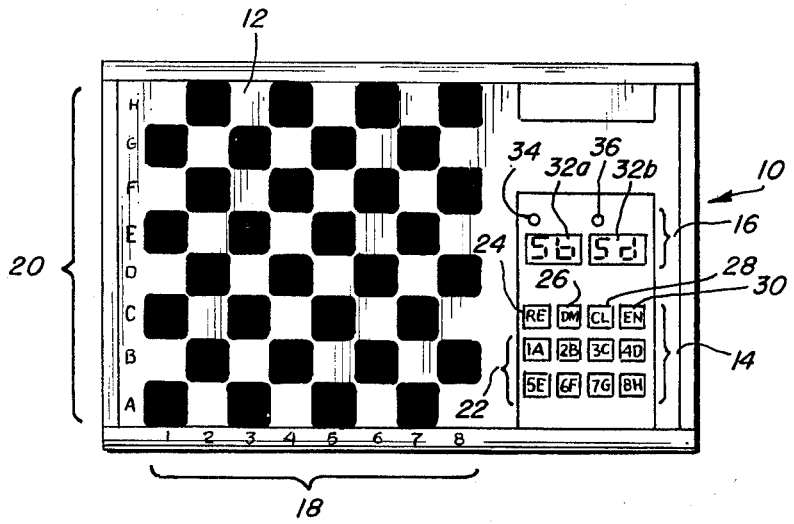
FIG. 1 is a plan view of the game for use in conjunction with the game playing system of the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

A game system incorporating the present invention may be embodied in a compact unit 10 which includes a game board 12, a control panel 14, and a display panel 16. The unit 10 contains the components utilized in the system of the present invention. For the purposes of illustration, the present invention will be disclosed for one game, the game of chess, although various aspects of the system incorporating the present invention may be used with other game systems as well.

Thus, as shown in FIG. 1, the game board 12 takes the form of a regular chess board on which may be disposed ordinary chess pieces to be manipulated by the player. One difference is that the chess board 12 has disposed along two edges, e.g., the bottom and one side, characters 18, 20 identifying each column and row, respectively. For convenience, the column characters 18 are shown as numbers and the row characters 20 are shown as letters. The letters and numbers define a matrix so that each square on the board is uniquely identified by one letter and one number.

The control board 14 comprises a keyboard that includes eight position data keys 22 corresponding to the eight columns and eight rows. Each of the data keys 22 may be utilized to select one of the column characters or numbers 18 and one of the row characters or letters 20, as a function of the sequence in which a key is actuated.

The position data keys are actuated sequentially to describe a player's move by first selecting row and column characters to define a first square, one from which a move is being made, and then selecting row and column characters to define a second square, one to which a move is being made. Thus, e.g., the first key actuated selects a column character, the second key actuated selects a row character, the third key actuated selects a column character and the fourth key actuated selects a row character.

If, for example, the player's pieces are white and in the beginning of the game are positioned in rows A and B, the opening move P-K4 would be achieved by actuating the following keys 22 in the following order: 5E key, **2*b* key, 5E key and 4*d*** key.

The control panel or keyboard 14 also includes four function keys, a reset key 24 for applying a reset signal to the system to initialize all conditions to a starting condition, a double move key 26 to allow for two moves such as may be required in castling, a clear key 28 to clear any keyboard entry error and an enter key 30 to enter data and to implement display of the position of each piece on the game board.

The display panel 16 is disposed above the control panel 14. The display panel 16 includes a character display 32 for displaying the column and row characters defining the moves of the player and of the machine, and a pair of indicator lights 34, 36. Indicator light 34 is energized when the player's king is in check and indicator light 36 is energized when the game system has lost the game.

The character display 32 is divided into discrete areas **32*a*, 32*b*, each displaying two characters, a column character and a row character. The first display area 32*a*** displays the first two data keys actuated, i.e., the column and row characters defining the first square—the one from which a chess piece is to be moved. The second display area displays the third and fourth data keys actuated, i.e., the column and row characters defining the second square—the one to which a piece is to be moved. Thus, the first and third characters displayed are always column-type characters, e.g., numbers, and the second and fourth characters displayed are always row type characters, e.g., letters.

Figure 2:
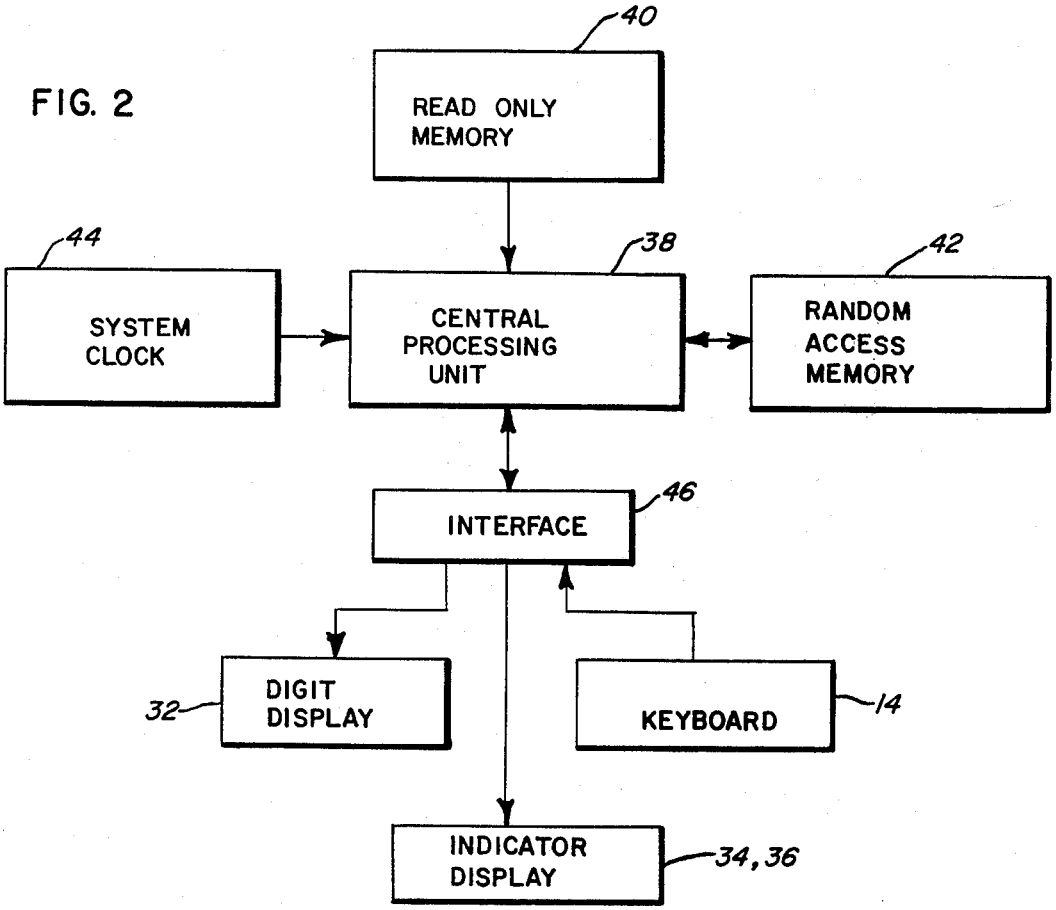
FIG. 2 is a block diagram of the major components utilized in the game of the present invention.

As shown in FIG. 2, the system of the present invention incorporates all of the major components of a micro processing system including central processor 38, a read only memory 40, random access memory 42, a system timing and clock circuit 44, an interface circuit 46 which interconnects the central processor 38 to the keyboard 14, to the character display 32 and to the display indicators 34, 36.

Figure 4:
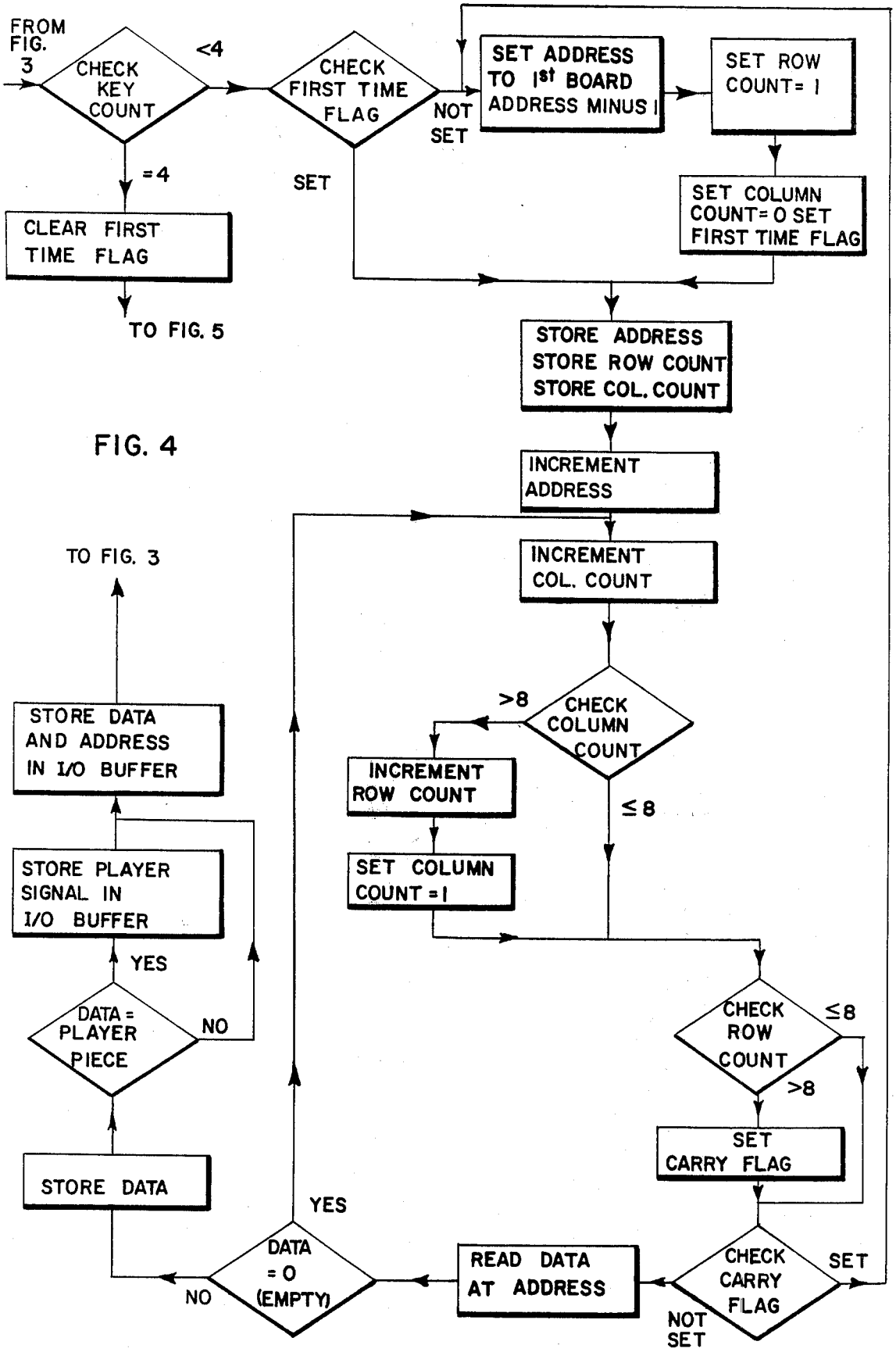
Figure 5:
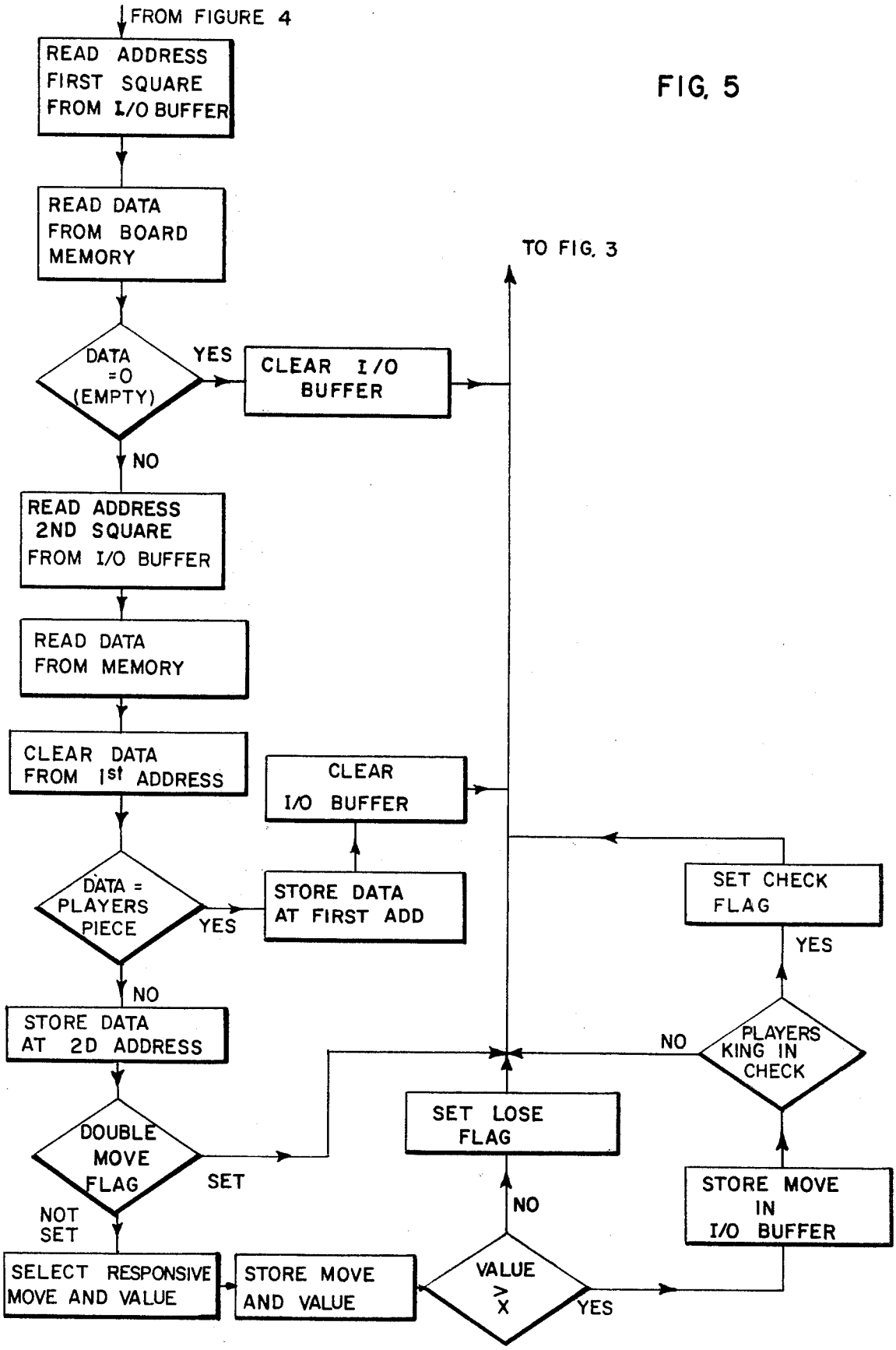

The operating cycle of the system of the present invention is shown in FIGS. 3, 4 and 5. When the system is first energized, or when the reset key 24 is actuated, all components of the system are reset to an initialized condition.

One of the initialized conditions is to store in memory at preselected addresses which correspond to the squares of the chess board game piece data signals which identify each of the chess pieces. The game piece data signals not only identify the type of chess piece, but also whether the piece is one normally moved by the player or one normally moved by the game system.

Thus, for example, pawns may be identified by a signal which is displayed as the number 2, knights by a signal displayed as the number 4, bishops by a signal displayed as the number 6, rooks by a signal displayed as the number 8, queens by a signal displayed as the letter A and kings by a signal displayed as the letter C. In addition, the signal identifying the player's pieces also indicates a component which, when identified, is displayed as the letter E (for the system's enemy).

In operation, the system continuously scans the keyboard 14 to determine whether any of the keys have been actuated. When a key is actuated, a different signal is produced in response to actuation of each of the function keys, double move key 26, clear key 28 and enter key 30. Another signal is produced when one of the data keys is actuated as well as a data signal identifying the particular key that has been actuated. The system scans the keyboard sequentially to read in order signals indicating whether the clear key 28 was actuated, the double entry key 26 was actuated, the enter key 30 was actuated or one of the data keys 22 was actuated.

If a signal appears on the line connected to the clear key 28, the system clears the input/output buffer, and therefore the display, any double entry flag which may have been stored and any key count that may have been accumulated. The system then returns to the beginning of the read key cycle. If the clear key 28 has not been actuated, the system then reads the output of the double move key 26. If the double move key 26 has been actuated, a double move signal is stored, i.e., the double move flag is set, for later use, and the system returns to the beginning of the cycle.

If the double move key has not been actuated, the system then reads the output from the enter key 30. If the enter key 30 is actuated, the system determines whether the enter key 30 has been actuated prematurely, i.e., whether the necessary number of data keys to define a move have been actuated, as will be described in more detail below, and provides a first or premature signal if the enter key 30 has been actuated prematurely and a second or enter signal if the system has not been actuated prematurely.

If the enter key 30 has not been actuated, the system then reads the fourth output from the keyboard 14 to determine whether one of the position data keys 22 has been actuated. Since the position data keys need be actuated only four times to completely define a move, i.e., two positions on the chess board, one from which a piece is to be moved and the other to which a piece is to be moved, each time a data key is actuated, a count is incremented and read. The value of the count determines whether actuation of a data key is a proper one. If the key has been actuated more than four times, the system ignores the actuation key and returns to the beginning of the cycle to read the keyboard.

If the key has been actuated four times or less, the system reads the count to see whether or not this is the first time the key has been actuated in the operational sequence. If it is the first time, the display is cleared by clearing its input/output buffer, and the identity of the key is stored in memory at the first address of the input-/output buffer. When the key is released, the system recycles to again read the keyboard.

If none of the keys are actuated, the system refreshes the display. The system reads the data stored at the input/output buffer section of the memory and checks to see whether that data stored equals zero. If the data is not a zero, the system checks to see whether the data being read is the first or third digit which is a number or the second and fourth digit which is a letter. If it is the second and fourth digit, the data must be modified to indicate that it is a letter.

The system then reads the data and compares the data read to a table which identifies the segments in the character display 32 which are to be energized to produce the indicated alpha or numeric character. The appropriate segment signals for the character are stored, the display is deenergized, the segment signals are then applied to and stored in the interface 46 along with any signals indicating that the check light 34 or the lose light 36 are to be energized. The appropriate character in the display is then energized along with the appropriate indicator light.

This display sequence recycles until all four character positions in the character display 32 have been energized. When all four digit positions have been displayed, the display is deenergized and the system returns to read any keys that may have been actuated.

In order to enter a complete move, it is necessary, as described above, to actuate the position data keys 22 four times. The first time a data key 22 is actuated, a column character is stored in the input/output buffer and is displayed. The second time the key is actuated, a row character is stored in the input/output buffer memory and displayed. These first two characters are displayed in an area which identifies the square from which a move is to be made. The next two times the data keys 22 are actuated, data representing a column and row are again stored and displayed in an area of the character display 22 which identifies the square to which a move is to be made. Thus, if the columns are identified by numbers and the rows by letters, a complete four digit display will be a number, followed by a letter, followed by a number, followed by a letter.

Referring to FIG. 4, if the enter key 30 is actuated before the data keys have been actuated the necessary four times to complete a move, the enter key has been actuated prematurely. This is determined by reading the count which is incremented each time a data key is actuated. If the count is equal to less than four, a first or premature signal is produced, and if the count is equal to four a second or enter signal is produced.

In response to the premature enter signal, the system is enabled to display the identity of each piece on the board together with the identity of the square on which that piece is located. Since each square of the game board is assigned a unique address in memory, the data stored at each such memory address is representative of a piece located on the corresponding square and, as described above, also identifies the piece as a piece normally moved by the player or a piece normally moved by the game system. Alternatively, the absence of a piece on a given square is also stored at the corresponding address.

Each time the enter key 30 is actuated prematurely, the system displays the identity of a piece and the square on which it is located by scanning the memory sequentially and providing an output to the display for each square at which a piece is located. This output identifies the square and the piece positioned on that square.

Thus, in response to the premature enter signal, the system checks to see whether or not this is the first time a premature enter key has occurred. If it is the first time, the system stores the address of the first square to be read and sets a row count to one to indicate that the first row is being scanned and a column count to zero. The first time flag is then set so that if a premature enter key occurs again, the system will not be reset to its initial conditions.

The address of the first square and the count values are stored in memory. The column count is incremented so that count information represents row 1, column 1, i.e., the first square. The system checks to see whether the column count is greater than 8 and if so resets the column count to one and increments the row counter by one. In this way, the system scans each square column by column and row by row. The system then checks the row count and if that is greater than 8 produces a carry or reset signal. If a carry signal is produced, the count and address are initialized by setting the address as the address of the first square and resetting the row count to one and the column count to zero.

The address in memory corresponding to the address signal is then read. If there is no data representing a piece stored at that address, the system recycles to increment the address to the next square and to increment the column count by 1. If the square is not empty, the data representing the piece stored at that address is read.

Before displaying the identity of that piece and its location, the system checks to see whether the data is representative of a machine piece, one normally moved by the game or of an enemy piece, one normally moved by the player. If it is an enemy piece, the system stores in the fourth position of the input/output buffer data which corresponds to the letter E. The system then stores in the input/output buffer data identifying the type of chess piece in position three and the identification of the square or address at positions one and two. The row and column counts are then stored in memory for later use when the enter key is next actuated prematurely, and the system recycles to read the keys and display the location of the piece and its identity.

Referring to FIG. 5, if actuation of the enter key was not premature, the system reads the piece data signals stored at the address corresponding to the first square identified by the first two data keys actuated to determine whether a piece is located on that square, i.e., whether data is stored at that memory address. If the data located at that address is representative of no piece, the data stored in the input/output buffer is cleared to preclude a move and the display is reset to all zeros. If a piece is located at the square identified by the first two characters, the system reads that data and stores it in a buffer memory. The data stored at the address identified by the last two digits is then read to determine whether there is a piece located at that address. If so, and if it is a player's piece, the move is an improper one. The input/output buffer is cleared and the display is reset to zero in order to inhibit and preclude the move.

If the move can be made, as indicated by the tests described above, the data read from memory at the first address is stored in memory at the second or to address and the data is erased from the first address. Thus, the board memory reflects the move by storing the identity of the piece at its new location and erasing it from its starting location.

If a player wants to make two moves consecutively, such as would be necessary in order to castle, the double move 26 key is actuated prior to the enter key 30. As indicated above, when the double move key 26 is actuated, a double move signal or flag is stored at a present address in memory. After the player's piece has been moved, as described above, the data stored at the double move address is read, and if the flag has been set the system recycles to read a subsequent keyboard entry. If the double entry flag has not been set, the system proceeds to evaluate and make its responsive move.

In accordance with one embodiment of the present invention, evaluation of possible responsive moves and selection of the responsive move to be made by the system is achieved by use of evaluation criteria such as is described in an article entitled "A Chess Playing Program For The 9810A" by Alan A. Wray in a Hewlett-Packard publication which program is available from Hewlett-Packard upon request. This program was modified to correct apparent errors and to render it compatible with components incorporated as part of the present system.

In substance, a responsive move is evaluated in accordance with these criteria. The result of this evaluation is a numeric value. The numeric value for each possible responsive move is stored and compared with the numeric value for a next possible move. The move having the highest numeric value and the value itself is stored in memory until all possible moves including castling have been evaluated.

When the responsive move having the greatest value has been selected, this value is compared with a preselected value which is indicative of the fact that the system's king is in check. Since the criteria utilized will cause the system to move out of check if at all possible, the fact that the best move, as indicated by the stored numeric value, still indicates that the king is in check also indicates that the machine cannot move the king out of check, i.e., the machine's king has been checkmated.

If this occurs, a signal is produced to energize the lose indicator light 36 to display the fact that the system has lost the game. The game system's move is not made and the display continues to display the last move made by the player.

If the best responsive move by the game system has a value greater than the value assigned to a king in check, and if the move is to be a castle, a castle flag signal is produced which allows the machine to move both the king and the rook and produce a coded display indicative of the fact that the system is castling. If the castling flag has not been set, the system moves its piece by storing the piece data at addresses corresponding to the square to which the piece is to be moved and clears this data from the address corresponding to the square from which the move is made. The identity of the two squares is stored in the input/output buffer memory for display by the system. The system also determines whether the square on which the player's king is located is under control of one of the system's pieces, i.e., whether the player's king is in check. If so, a signal is produced to energize the check indicator light 34 during the display cycle.

In one embodiment of the system incorporating the present invention, the central processor 38 takes the form of a model 8080 C.P.U., the read only memory takes the form of a model 2316 ROM, the random access memory 42 takes the form of four model 2101 RAM's, the system timing and clock circuit 44 incorporates models 8224 and 8228 clock circuits, and the interface circuit 46 is a model 8255.

Thus, there has been disclosed a game playing system for a game of the type normally played by two players in which the game system simulates the play of one of the players. A system incorporating the present invention is relatively inexpensive and is packaged in a relatively compact self-contained unit and is capable of being operated by one who is not sophisticated in data processing. A system incorporating the present invention is able to selectively display the position of each piece on the game board and the identity of the piece at each location along with the identity of whether it is a player's piece or a system piece; is able to provide a display when the system has lost the game and when the player's king is in check.

From the foregoing, it will be observed that numerous variations and modifications may be effected without departing from the true spirit and scope of the novel concept of the invention. It is, of course, intended to cover by the appended claims all such modifications as fall within the scope of the claims.

I claim:

1. In an electronic board game of the type in which a plurality of pieces are movable between discrete positions on a game board and normally played between two players, a game playing system for use by one player in which the system responds to pieces moved by the one player by making responsive moves of pieces normally moved by the other player; comprising:

memory means having a distinct address for each of said discrete board positions and having stored at selected ones of said board position memory addresses first data signals representative of said game pieces to represent the position of said pieces on the game board and having stored at the remaining ones of said board position addresses second data signals representative of an empty board position;

a plurality of manually actuatable data input keys for producing position data signals to identify said memory addresses and thereby define said discrete board positions;

addressable input/output buffer means;

means responsive to sequential manual actuation of said data input keys for storing said position data signals in said input/output buffer means at addresses determined by the sequence of key actuation to thereby store in said input/output buffer means data signals defining a first discrete position from which a piece is being moved and a second discrete position to which said piece is being moved;

means for displaying the data signals stored in said input/output buffer means whereby said first and second discrete positions are displayed for a player;

a manually actuatable function key for implementing a move represented by said position data signals stored in said input/output buffer means and for alternatively implementing sequential display of the position of each piece on the game board;

means responsive to actuation of said function key for reading said position data signals stored in said input/output buffer means and for alternatively producing a premature signal when said data input keys have not been actuated to define said first and second discrete positions and an enter signal in response to actuation of said data input keys to define said first and second discrete positions;

means responsive to said premature signal for reading game piece data signals from a first one of said board position memory addresses and for alternatively producing an empty control signal when said empty data signals are stored at said first board position memory address and a filled control signal when said game piece data signals are stored at said first board position memory address;

means responsive to said empty control signal for causing said premature signal responsive means to read data signals from a second one of said board position memory addresses;

means responsive to said filled control signal for storing in said input/output buffer means said game piece data signals read from said board position memory address and discrete position signals corresponding to said board position memory address from which said game piece data signals are read whereby the identity of said discrete position and the game piece located at said discrete position may be displayed;

piece moving means, including means responsive to said enter signal and to said position data signals stored in said input/output buffer means for reading from said memory means game piece data signals stored at a first board position memory address corresponding to said first discrete position, and means for storing said game piece data signals in said memory means at a second board position memory address corresponding to said second discrete position, whereby a player's piece is moved in accordance with the position data signals stored in said input/output buffer means;

whereby the position data signals representative of said responsive move is displayed.

2. A game playing system as claimed in claim 1, wherein:

said means for producing said empty and filled control signals is responsive to successive premature entry signals for producing additional empty and filled control signals to effect sequential display of each discrete position at which a game piece is located and the identity of the game piece at such position.

3. A game playing system as claimed in claim 2, wherein:

each of said game piece data signals stored in said memory means further represents each game piece as a game piece to be moved by the game system or as a game piece to be moved by the player; and including means responsive to said filled control signal for identifying said first game piece data signals as player game pieces and for producing a player piece display signal in response thereto, and means responsive to said player piece display signal for storing in said input/output buffer means data identifying said game piece as a player game piece for display with the identity of said discrete position and the game piece located at said position.

4. A game playing system as claimed in claim 1 including:

means for identifying said data signals read from said memory means at said first board position memory address as game piece data signals or empty data signals and for producing respectively first and second indicator signals;

said piece moving means including means responsive to said first indicator signal for storing said game piece signals in said memory means at said second board position memory address.

5. A game playing system as claimed in claim 4 wherein:

said piece moving means includes further means responsive to said first indicator signal for storing empty data signals in said memory means at said first board position memory address.

6. A game playing system as claimed in claim 4 including:

means responsive to said second indicator signal for precluding storage of said empty data signal in said memory means at said second board position address, whereby a move from an empty position is prevented.

7. A game playing system as claimed in claim 6 wherein:

said move preventing means comprises means responsive to said second indicator signal for clearing said position data signals from said input/output buffer means, whereby the absence of data signals indentifying said board position memory addresses prevents storage of piece data signals at said memory means.

8. A game playing system as claimed in claim 4 wherein:

each of said game piece data signals stored in said memory means further identifies each game piece as a game piece to be moved by the game system or as a game piece to be moved by the player, and including:

means responsive to said first indicator signal for reading said data signals from said memory means at said second board position memory address for identifying said data signals read from said second borad position memory address as a game piece data signal representing a player's game piece, and for producing a third indicator signal in response to such identification; and means responsive to said third indicator signal for precluding said game piece data signal read from said memory means at said first board position memory address from being stored in said memory means at said second board position memory address, whereby a move to a position occupied by a player's piece is prevented.

9. A game playing system as claimed in claim 8 wherein:

said move preventing means includes means responsive to said third indicator signal for clearing said position data signals from said input/output buffer means, whereby the absence of data signals identifying said board position memory addresses prevents storage of piece data signals in said memory means.

10. A game playing system as claimed in claim 1 wherein:

said responsive move selection means produces a signal representative of a numerical value for each possible responsive move in accordance with said preselected criteria, and selects the responsive move having the highest numerical value assigned thereto; and including means for reading said numerical value signals for said selected responsive move and for comparing its value thereof with a preselected numerical value representing the highest value when the game system loses the game, means for producing a display indicator signal when said preset value is greater than the value of said selected responsive move; and means responsive to said display indicator signal for energizing a display indicator for display to the player that the game system loses the game.

11. In an electronic chess game, a game playing system for use by one player in which the system responds to chess pieces moved by the one player by making responsive moves of chess pieces normally moved by a second player; comprising:

memory means having a distinct address for each square on a chess board and having stored at selected ones of said board position memory addresses first data signals representative of said chess pieces to represent in said memory means the position of each of said chess pieces on the chess board and having stored at the remaining ones of said board position addresses second data signals representative of an empty square;

each of said chess piece data signals further representing the type of chess piece and whether the chess piece is normally movable by the game system or by the player;

a plurality of manually actuatable data input keys for producing discrete position data signals to identify said memory addresses and thereby define said chess board squares;

addressable input/output buffer means;

means responsive to sequential manual actuation of said data input keys for storing said position data signals in said input/output buffer means at addresses determined by the sequence of key actuation to thereby store in said input/output buffer means data signals defining a first board square from which a piece is being moved and a second board square to which said piece is being moved;

means for displaying the data signals stored in said input/output buffer means whereby the identity of said first and second board squares are displayed for a player;

a manually actuatable function key for implementing a move represented by said position data signals stored in said input/output buffer means and for alternatively implementing sequential display of the square at which each chess piece is located;

means reponsive to actuation of said function key for reading said position data signals stored in said input/output buffer means and for alternatively producing a premature signal when said data input keys have not been manually actuated to define said first and second squares and an enter signal in response to manual actuation of said data input keys to define said first and second squares;

means responsive to said premature signal for reading chess piece data signals from a first one of said board position memory addresses and for alternatively producing an empty control signal when said empty square data signals are stored aat said first board position memory address, and a filled control signal when one of said chess piece data signals are stored at said first board position memory address;

means responsive to said empty control signal for causing said premature signal responsive means to read data signals from a second one of said board position memory addresses;

means responsive to said filled control signal for storing in input/output buffer means said chess piece data signals read from said board position memory address and discrete position signals corresponding to said board position memory address from which said chess piece data signals are read whereby the identity of said chess board square and said chess piece located on said square may be displayed;

piece moving means, including means responsive to said enter signal and to said position data signals stored in said input/output means for reading from said memory means chess piece data signals stored at a first board position memory address corresponding to said first chess board square and means for storing said chess piece data signals in said memory means at a second board position memory address corresponding to said second chess board square, whereby a player's piece is moved in accordance with the position data signals stored in said input/output buffer means;

means responsive to said movement of a player's chess piece for selecting a responsive move in accordance with preselected criteria stored in memory;

said piece moving means being responsive to said selection of responsive move for making a move in said memory means as aforesaid; and means for storing position data signals representing chess board squares from which and to which said responsive move is made in said input/output buffer means, whereby the position data signals representative of said responsive move is displayed.

* * * * *